US006363811B1

(12) United States Patent
Saldaña

(10) Patent No.: US 6,363,811 B1
(45) Date of Patent: Apr. 2, 2002

(54) PARKING BRAKE CABLE OPERATING MECHANISM

(75) Inventor: Sergio Saldaña, Troy, MI (US)

(73) Assignee: Ficosa North American Corp., Troy, MI (US)

( * ) Notice: Subject to any disclaimer, the term of this patent is extended or adjusted under 35 U.S.C. 154(b) by 0 days.

(21) Appl. No.: 09/520,193

(22) Filed: Mar. 7, 2000

(51) Int. Cl.[7] ..... G05G 1/14

(52) U.S. Cl. ..... 74/512; 74/535; 74/560; 74/505; 74/506

(58) Field of Search ..... 74/535, 537, 529, 74/501.5 R, 538, 533, 575, 577 R, 512, 505, 513, 506, 560, 531; 188/290, 291, 77 W, 271

(56) References Cited

U.S. PATENT DOCUMENTS

| | | | | | |
|---|---|---|---|---|---|
| 3,136,177 | A | | 6/1964 | Roberts et al. | |
| 3,149,500 | A | | 9/1964 | Swats et al. | |
| 4,612,823 | A | | 9/1986 | De Leeue et al. | |
| 4,841,798 | A | * | 6/1989 | Porter et al. | 74/501.5 R |
| 4,850,242 | A | | 7/1989 | Haas et al. | |
| 5,001,942 | A | * | 3/1991 | Boyer | 74/535 |
| 5,303,610 | A | * | 4/1994 | Noel et al. | 74/535 |
| 5,448,928 | A | * | 9/1995 | Harger | 74/523 |
| 5,533,420 | A | * | 7/1996 | Perisho | 74/512 |
| 5,787,761 | A | * | 8/1998 | Wang | 74/535 |
| 5,819,595 | A | * | 10/1998 | Cebollero | 74/535 |
| 5,907,977 | A | * | 6/1999 | Huebner et al. | 74/501.5 R |

FOREIGN PATENT DOCUMENTS

| | | | | |
|---|---|---|---|---|
| JP | 5-213165 | * | 8/1993 | 74/535 |
| JP | 2000-177548 | * | 6/2000 | 74/535 |

* cited by examiner

*Primary Examiner*—Vinh T. Luong
(74) *Attorney, Agent, or Firm*—Reising, Ethington, Barnes, Kisselle, Learman & McCulloch, P.C.

(57) ABSTRACT

Apparatus for selectively applying tension to a parking brake cable that includes a pulley for coupling to the cable and having a cable groove that is non-circular about an axis of the pulley. A lever is coupled to the pulley for rotating the pulley in one direction about its axis, and thereby winding the cable into the groove to apply tension to the cable. A clutch is coupled to the pulley to prevent reverse rotation of the pulley, and a release mechanism is coupled to the clutch for releasing the clutch and thereby releasing tension in the cable. The non-circular groove has a maximum radius where the cable is wound into the groove upon initial operation of the lever, and a decreasing radius thereafter. In this way, force is applied to the parking brake cable at maximum rate of change upon initial actuation of the lever, increasing at a lower rate as the lever is further depressed.

11 Claims, 6 Drawing Sheets

PARKING BRAKE CABLE OPERATING MECHANISM

The present invention is directed to an apparatus for selectively applying tension to a parking brake cable in an automotive vehicle or the like.

BACKGROUND AND SUMMARY OF THE INVENTION

Apparatus for selectively applying tension to a parking brake cable typically includes a lever, such as a foot lever, responsive to a vehicle operator for applying tension to a cable and thereby setting the parking brake. A hand-operated mechanism is provided for selectively releasing the brake. It is a general object of the present invention to provide an apparatus of this type in which the force applied to the parking brake cable is a variable function of operation of the lever. Another object of the present invention is to provide an apparatus of the described character that is readily adaptable for use in conjunction with a variety of vehicles, and in which the force characteristic of the apparatus may be varied for vehicles of differing sizes while maintaining commonality of parts. Yet another object of the present invention is to provide an apparatus of the described character having improved stability at the operating lever.

Apparatus for selectively applying tension to a parking brake cable in accordance with a presently preferred embodiment of the invention comprises a pulley for coupling to the brake cable and having a cable groove that is non-circular about the axis of rotation of the pulley. A lever is coupled to the pulley for rotating the pulley in one direction about its axis and thereby winding the cable into the groove to apply tension to the cable. A clutch is coupled to the pulley to prevent reverse rotation of the pulley, and a release mechanism is coupled to the clutch for releasing the clutch and thereby releasing tension in the cable. In the preferred embodiment of the invention, the non-circular groove has a maximum radius where the cable is wound into the groove upon initial operation of the lever, and a decreasing radius thereafter. In this way, force is applied to the parking brake cable at maximum rate upon initial actuation of the lever, increasing at a lesser rate as the lever is further depressed.

In the preferred embodiment of the invention, the pulley comprises first and second flat circular plates, with the cable groove being formed by a groove base carried by the second plate and groove sidewalls formed by the first and second plates. The first plate includes facility for attachment of the cable, and a spring is coupled to the first plate for maintaining tension in the cable after the cable has been released so that the cable will not be slack. The spring may comprise a coil spring that extends between peripheral portions of the first and second plates. Alternatively or additionally, the spring may couple the pulley to a shaft on which the pulley is mounted for rotation. The clutch in the preferred embodiment of the invention comprises a first helical spring that encircles a hub that extends from the first pulley plate. A second helical spring encircles a hub that extends from the opposing side of the first plate and operatively couples the lever to the pulley. The lever preferably has a pair of legs rotatably mounted on the hub on opposite sides of the second helical spring for adding stability to the lever, which may be either of one-piece construction or a two-piece assembly. The pulley mechanism is mounted for rotation on a mounting plate, and a bracket enclosing the pulley mechanism. The second helical spring has opposed ends coupled to the bracket and the lever for transferring operation of the lever to rotation of the pulley.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENTS

Figure 7:
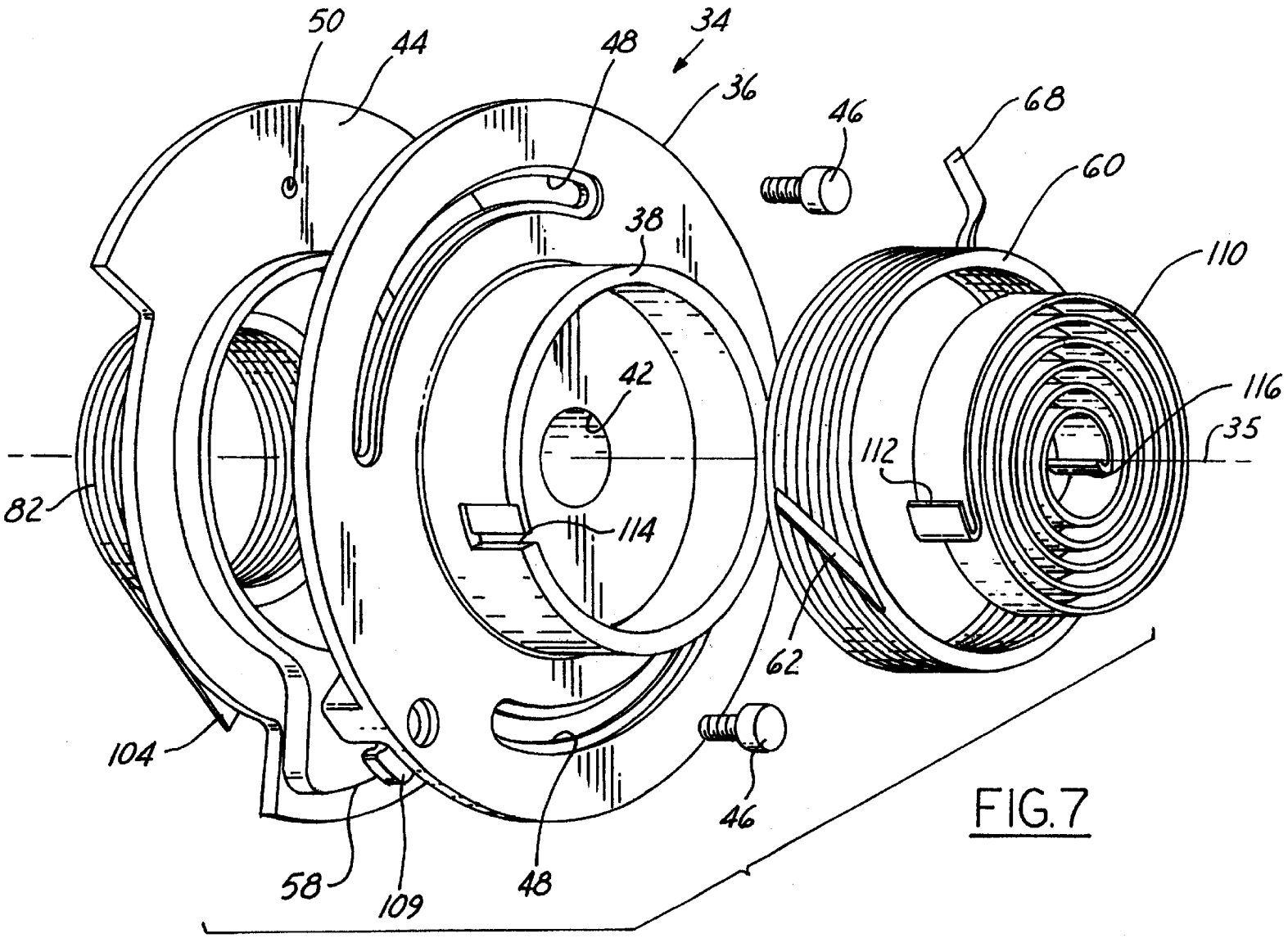
FIG. 7 is an exploded perspective view of the pulley subassembly in the mechanism of FIGS. 1–6.
Figure 8:
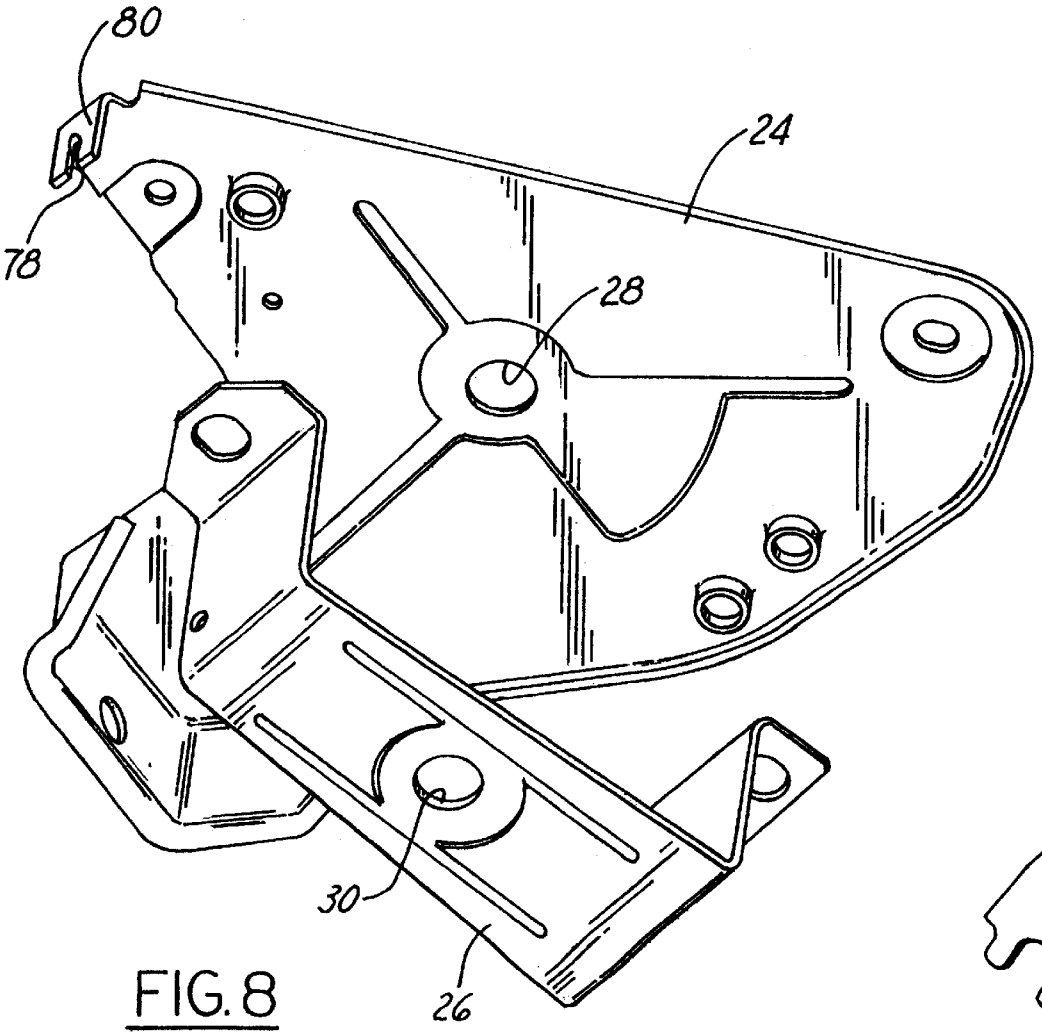
FIG. 8 is a perspective view of the mounting plate and bracket in the mechanism of FIGS. 1–6.
Figure 10:
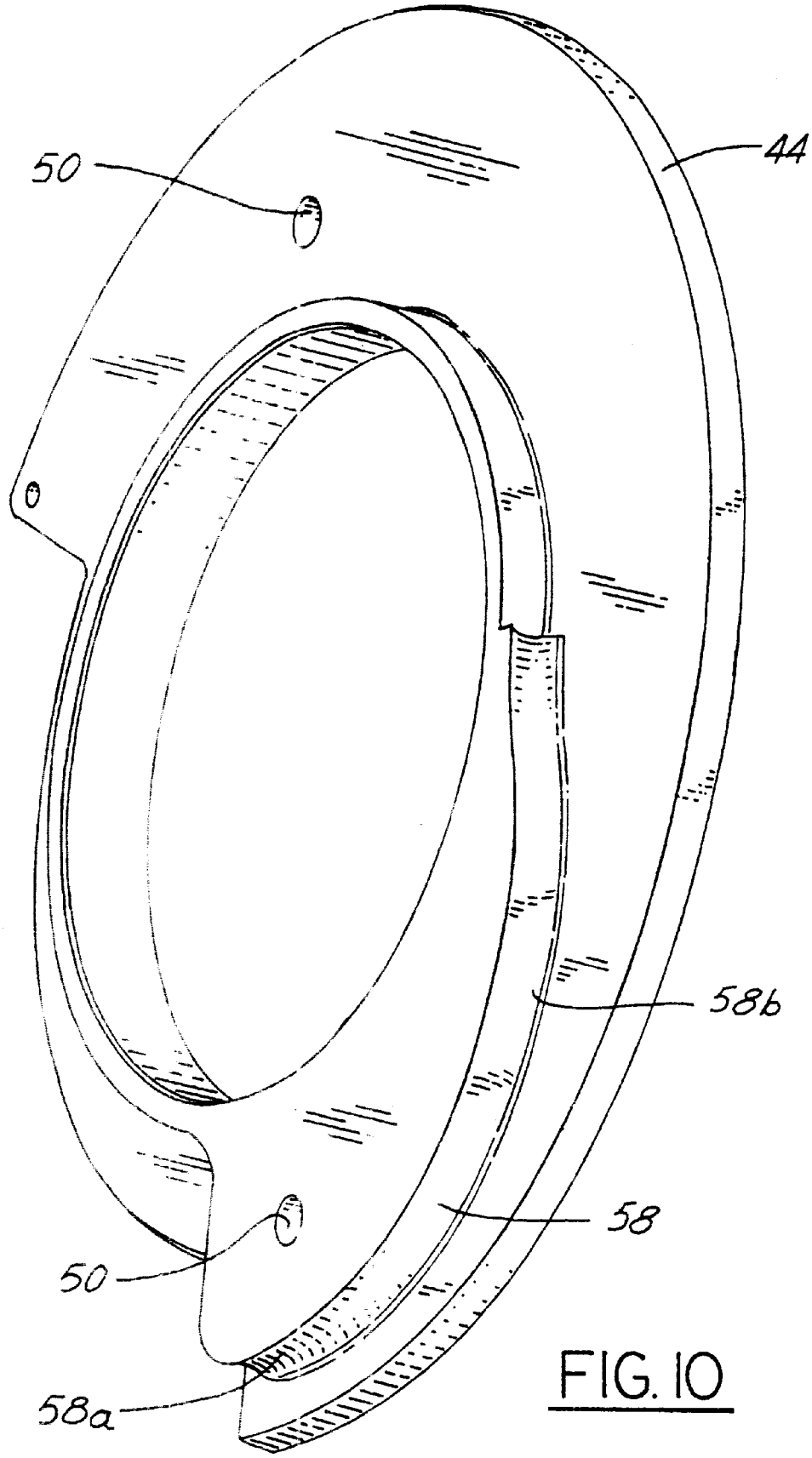
FIG. 10 is a perspective view of one of the pulley plates in the mechanism of FIGS. 1–7.

The drawings illustrate an apparatus 20 for selectively applying tension to a parking brake cable 22 in accordance with a presently preferred embodiment of the invention as comprising a mounting plate 24 on which the remainder of the apparatus is mounted. A bracket 26 is secured to mounting plate 24, and mounting plate 24 and bracket 26 define a pair of aligned holes 28, 30 (FIG. 8) within which a shaft 32 is fixedly secured. A pulley subassembly 34 (FIGS. 1–7) is rotatably mounted on shaft 32 and has an axis of rotation 35 (FIG. 7). Pulley subassembly 34 comprises a first flat circular plate 36 having a pair of hubs 38, 40 projecting from opposite lateral sides concentrically with each other and with a central opening 42 that is carried by shaft 32. A second plate 44 is secured to first plate 36 by a plurality of screws 46 (FIGS. 2 and 7). Screws 46 respectively extend through diametrically opposed arcuate slots 48 in first pulley 36 into internally threaded openings 50 in second pulley 44. In this way, pulleys 36, 44 are secured to each other for limited rotation with respect to each other over an angle defined by the arcuate circumferential dimension of slots 48, which extend over arcs that are concentric with each other and with pulley central opening 42. A groove 52 is defined between the peripheries of plates 36, 44 for receiving parking brake cable 22 as the latter is wound onto the pulley by operation of the parking brake mechanism. This groove 52 has spaced sidewalls 54, 56 defined by the opposing peripheral surfaces of plates 36, 44 respectively, and has a groove root or base defined by a ledge 58 on the inside face of plate 44. As best seen in FIGS. 7 and 10, this ledge 58 is non-circular with respect to the central axis of rotation of plate 44 having a greatest radius at the initial portion 58*a* of groove 52 and a rapidly decreasing radius thereafter at groove portion 58*b*.

Figure 9:
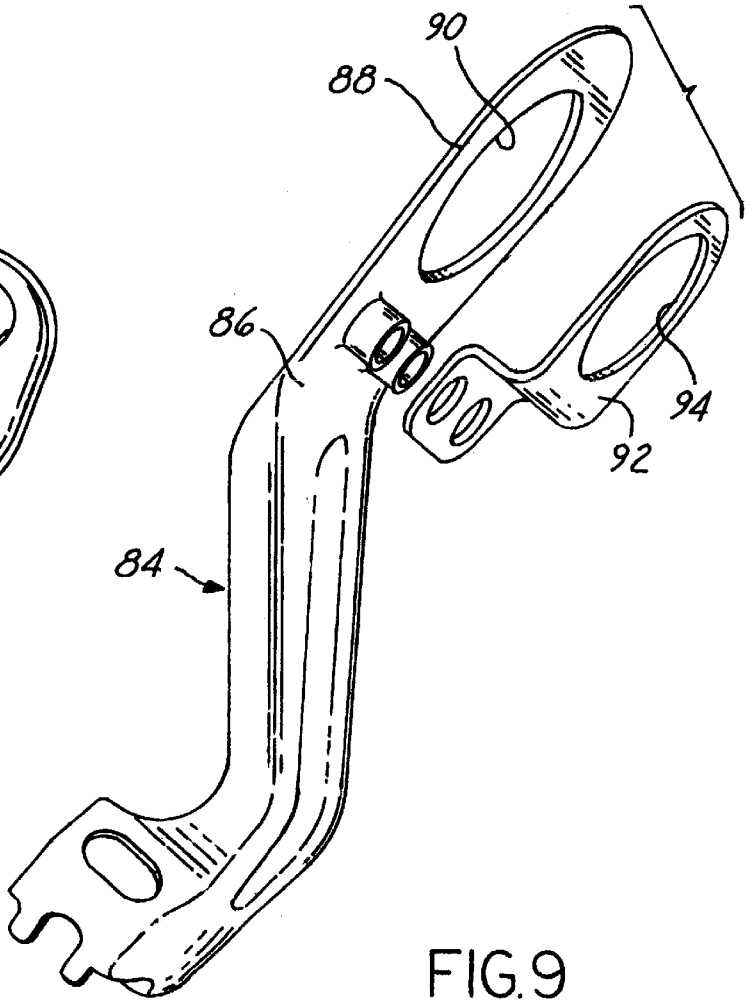
FIG. 9 is an exploded perspective view of the operating lever in the mechanism of FIGS. 1–6.

A helical clutch spring 60 encircles hub 38 on plate 36. Clutch spring 60 has one radially outwardly extending end 62 that is secured by a bracket 64 and a screw 66 (FIGS. 1, 3 and 6) in fixed position to the opposing inside face of mounting plate 24. A second end 68 of spring 60 rests against one arm of a lever 70, which is mounted on plate 24 by a pin 72 for rotation about an axis that is fixed with respect to plate 24. The opposing end of lever 70 is connected by a rod 74 to a brake release handle 76 for selective release of tension in parking brake cable 22, as will be described. Rod 74 extends upwardly from lever 70, and is slidably received in a slot 78 formed in an arm 80 that extends from the plane of mounting plate 24. A coil spring 81 is captured in compression between arm 80 and bend rod 74 to bias rod 74 and handle to the clutch-engaged position of the drawings. A second helical spring 82 encircles hub 40 of plate 36. An operator lever 84 is also rotatably mounted on hub 40. As best seen in FIG. 9, lever 84 includes a body 86 that forms a first leg 88 with an internal opening 90 sized to encircle hub 40. A second leg 92 is secured to body 86, and forms a second opening 94 for journaled support on hub 40. Thus, openings 90, 94 are concentric and sized for free rotation on hub 40. Legs 88, 92 are spaced from each other so as to be disposed on opposite sides of spring 82 carried by hub 40. The spaced legs 88, 92 provide improved stability for lever 84, which has an operator foot pad 96 at its free end. As an alternative to the two-piece construction of lever 84 illustrated in the drawings, lever 84 may be provided as a one-piece molded or cast unit.

Spring 82 has one end 98 that is secured by a plate 100 and a screw 102 to an opposing inside face of lever leg 88. An opposing end 104 of spring 82 is in circumferential abutment with a pin 106 (FIG. 3) that extends radially inwardly from bracket 26. A coil spring 108 extends in tension between a mounting lug 109 on the inner surface of first plate 36 and an opening at the periphery of second plate 44. Thus spring 108 biases plates 44, 36 with respect to each other. A flat spiral spring 110 is disposed within hub 38 of first plate 36. Spring 110 has an outer end 112 that is slidably received in a slot 114 formed in hub 38, and has an inner end 116 that is slidably received in a slot 118 in shaft 32. Thus, spring 110 biases plate 36 with respect to fixed shaft 32, and spring 108 biases second plate 44 with respect to first plate 36. Parking brake cable 22 terminates in a cylindrical lug 120 (FIG. 1) that is mounted in a corresponding recess on lug 109 secured to plate 36. A bumper 124 is mounted on bracket 26 at a position for engagement by lever 34 upon release of the parking brake mechanism.

Figure 1:
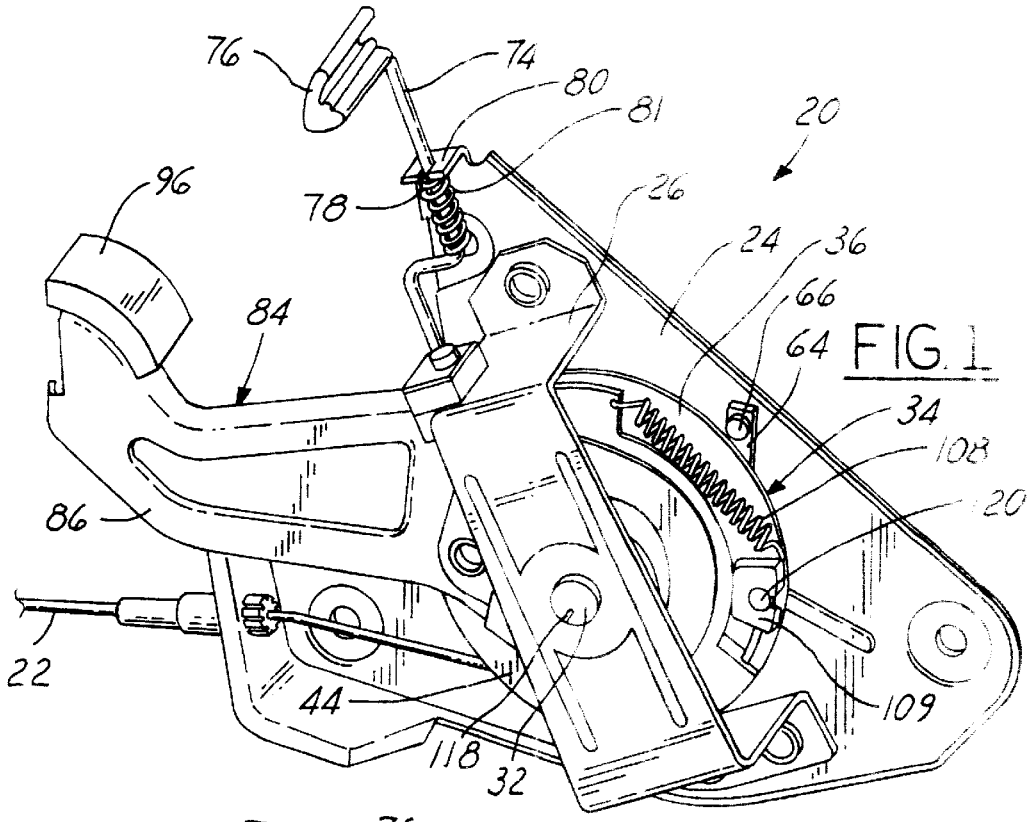
FIG. 1 is a perspective elevational view of a parking brake mechanism in accordance with a presently preferred embodiment of the invention.
Figure 2:
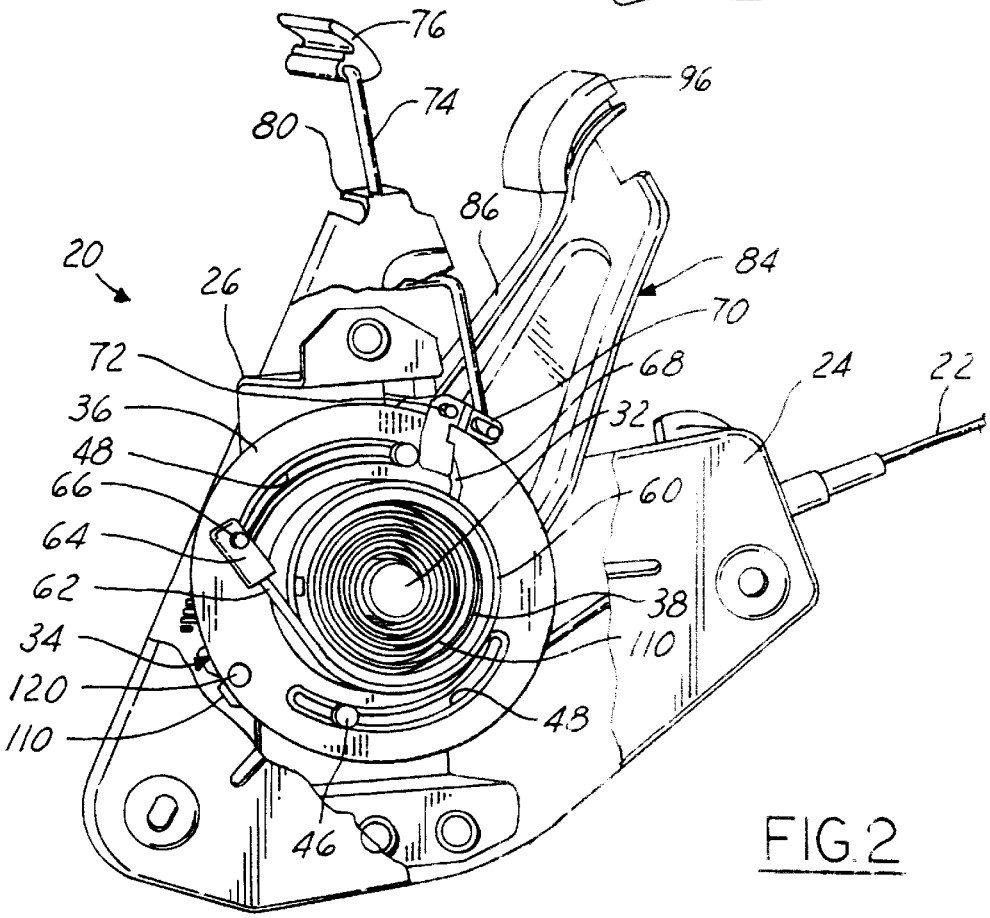
FIG. 2 is a rear perspective view of the mechanism of FIG. 1 with a portion of the mounting plate broken away to reveal internal details.
Figure 3:
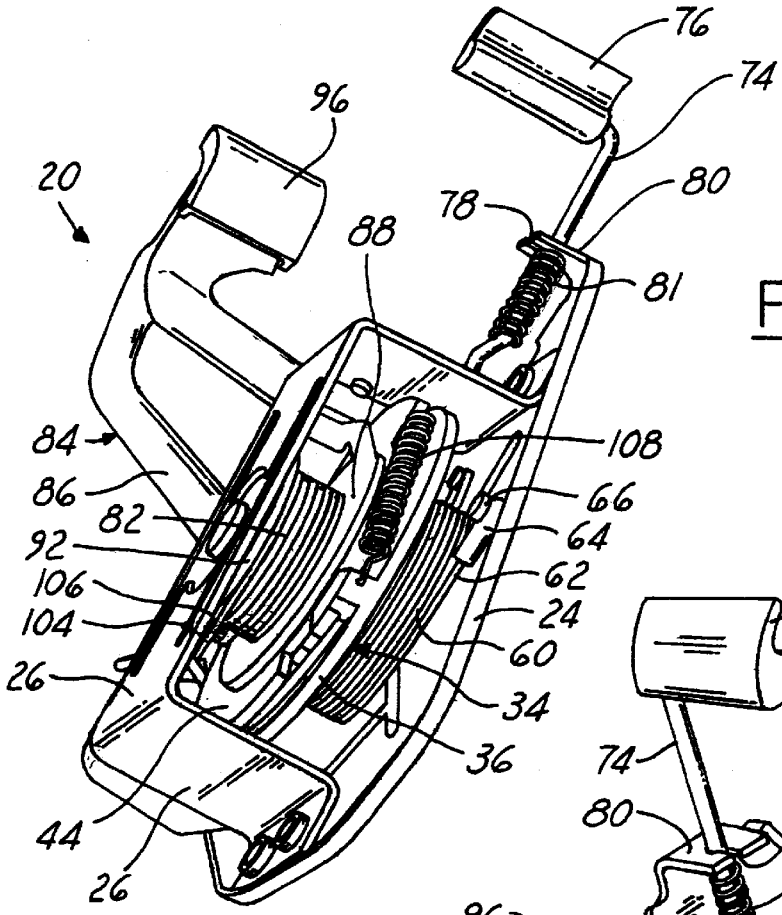
FIG. 3 is a top plan perspective view of the mechanism illustrated in FIGS. 1 and 2.
Figure 4:
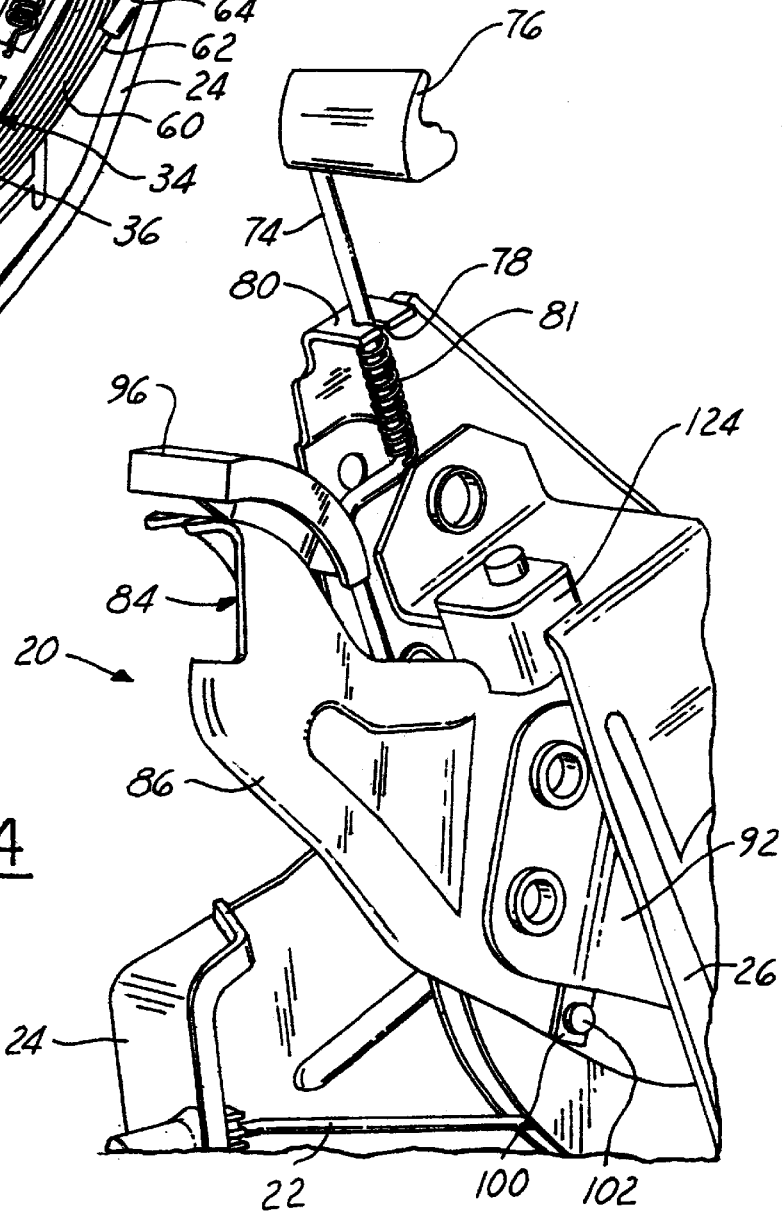
FIG. 4 is a fragmentary side perspective view of the mechanism illustrated in FIGS. 1–3.
Figure 6:
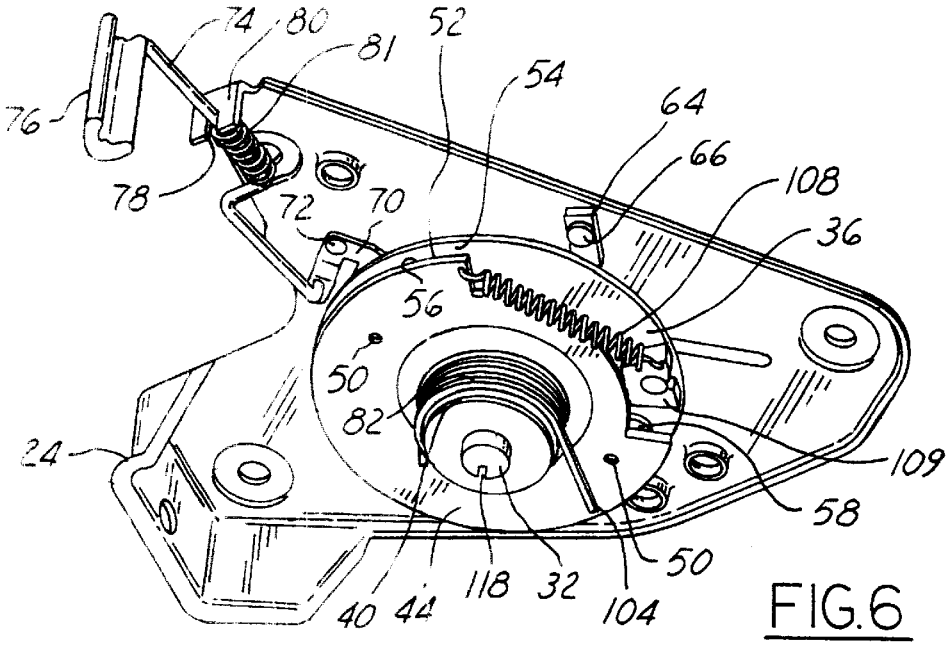
FIG. 6 is a perspective view of the parking brake mechanism in accordance with the preferred embodiment of the invention, again with portions broken away to reveal internal details.
Figure 5:
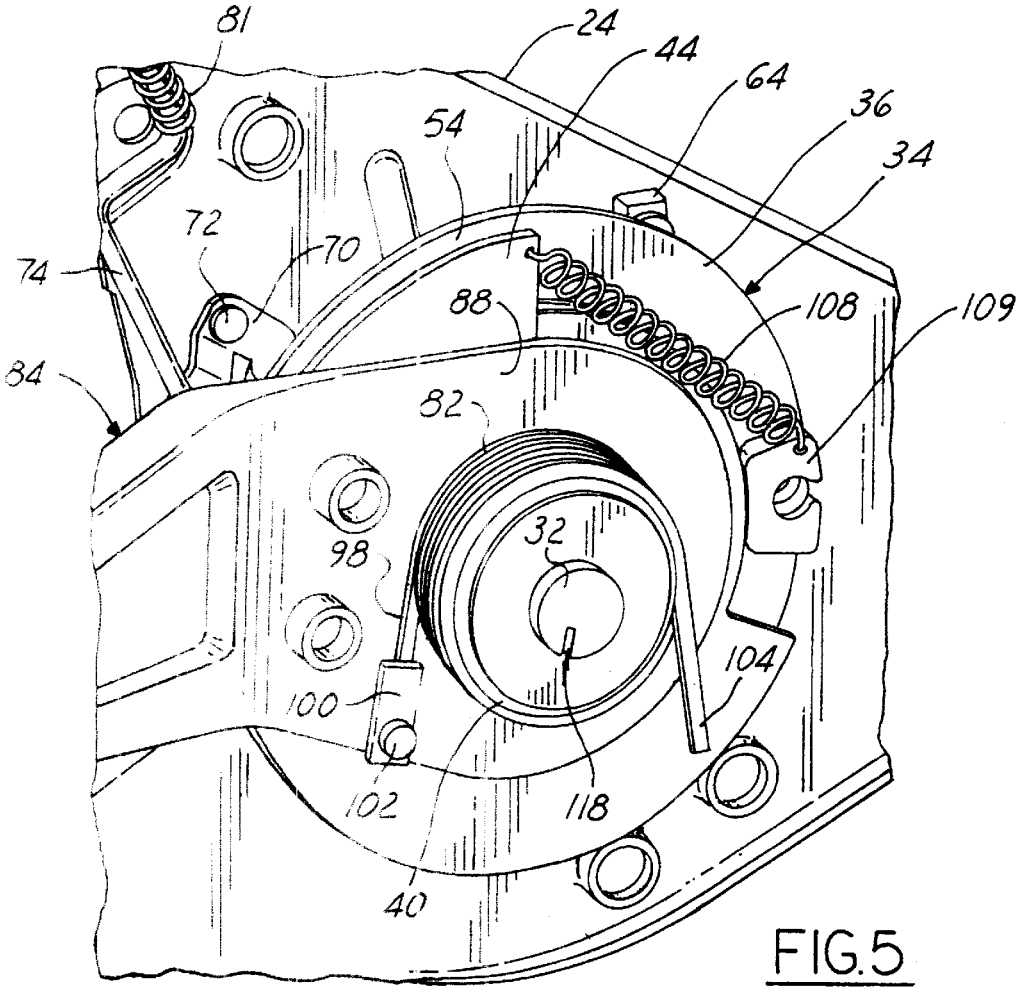
FIG. 5 is a fragmentary perspective view of the parking brake mechanism with portions broken away to illustrate internal details.

In operation, with the parking brake released, lever 84 is in abutting engagement with pad 124 and springs 108, 110 biases plate 36 counterclockwise in the orientation of FIG. 1 so as to maintain a minimum tension in parking brake cable 22 so that the cable will not be slack. Clutch spring 60 is normally in frictional engagement with hub 38, and spring 82 is normally out of frictional engagement with hub 40. When lever 84 is actuated by a vehicle operator by depression of lever foot pad 96, spring 82 tightens around hub 40 so as to rotate pulley 34 counterclockwise in the orientation of FIG. 1. Cable 22 winds into pulley groove 52, during the initial portion of the pulley, at greatest radius from the axis 35 of pulley rotation. This functions to apply force to the parking brake cable at a maximum rate of change during such initial depression of lever 84. More particularly, in the example disclosed, it will be seen that maximum cable travel or displacement occurs during initial travel of foot pad 96, with less force multiplication occurring initially, and then maximum mechanical advantage is developed at end of the travel of cable 22 and foot pad 96. Clutch spring 60 prevents reverse rotation of pulley 34. Thus, lever 84 may be pumped by an operator to apply tension in cable 22, and such tension will be maintained by operation of clutch spring 60. To release tension in the parking brake cable, handle 76 and rod 74 are lifted with respect to mounting plate 24 against the force of spring 81. This rotates brake release lever 70 about pin 72 in the counterclockwise direction in the orientation of FIG. 2. Such rotation of lever 70 against spring end 68 functions to expand clutch spring 60 and thereby release pulley 34. The tension in cable 22 causes clockwise rotation of pulley 34 in the orientation of FIG. 1, releasing tension in the cable. However, cable 22 will not go slack because of springs 108, 110. Upon release, lever 84 will abut bumper 24, whereupon the parking brake mechanism is returned to its initial configuration.

There has thus been disclosed a parking brake mechanism that fully satisfies all of the objects and aims previously set forth. Pulley assembly 34, and particularly the non-circular pulley groove configuration, provides a variable force application rate in response to actuation of the operating lever. Furthermore, the parking brake mechanism of the present invention may be readily tailored to vehicles of differing size and weight, and differing parking brake force characteristics, by merely replacing second plate 44, while all of the remaining components remain the same. Provision of spaced legs 88, 92 on operating lever 84 provide for improved stability of the operating lever during actuation by an operator. As previously noted, operating lever 84 may be provided as a two-piece unit as illustrated, or as a single-piece unit. Several modifications and variations to the apparatus of the invention have thus been disclosed. Other modifications and variations will readily suggest themselves to persons of ordinary skill in the art. The invention is intended to embrace all such modifications and variations as fall within the spirit and broad scope of the appended claims.

What is claimed is:

1. Apparatus for selectively applying tension to a parking brake cable, which comprises:

a pulley for coupling to the cable and having a cable groove that is non-circular about an axis of said pulley, said pulley comprising first and second flat circular plates, said groove being formed by a groove base carried by said second plate and groove sidewalls formed by said first and second plates, a lever coupled to said pulley for rotating said pulley in one direction about said axis and thereby selectively winding the cable into said groove to apply tension to the cable, clutch means coupled to said pulley to prevent reverse rotation of said pulley, and release means coupled to said clutch means for releasing said clutch means and thereby releasing tension in said cable.

2. The apparatus set forth in claim 1 wherein said non-circular groove has a maximum radius where said cable is wound into said groove upon initial operation of said lever and a decreasing radius thereafter.

3. The apparatus set forth in claim 1 wherein said first plate includes means for attachment of said cable, and wherein said apparatus further includes a spring coupled to said first plate for maintaining tension in said cable after said clutch means has been released.

4. The apparatus set forth in claim 3 wherein said spring extends between said first and second plates.

5. The apparatus set forth in claim 4 wherein said spring comprises a coil spring extending between peripheral portions of said first and second plates.

6. The apparatus set forth in claim 3 wherein said pulley is mounted for rotation about a shaft, and wherein said spring couples said first plate to said shaft.

7. The apparatus set forth in claim 6 wherein said first plate has hubs extending axially from opposed sides of said first plate around said shaft, wherein said second plate is rotatably mounted on a first of said hubs and said spring comprises a spiral spring disposed within a second of said hubs.

8. The apparatus set forth in claim 7 wherein said clutch means comprises a first helical spring encircling said second hub.

9. The apparatus set forth in claim 8 further comprising a second helical spring encircling said first hub and operatively coupling said lever to said pulley.

10. The apparatus set forth in claim 9 wherein said lever has a pair of legs rotatably mounted on said first hub on opposed sides of said second helical spring.

11. The apparatus set forth in claim 10 further comprising a bracket mounted on a mounting plate enclosing said pulley, said second helical spring having opposed ends coupled with said bracket and said lever.

* * * * *